US009387597B2

(12) United States Patent
Birbil

(10) Patent No.: US 9,387,597 B2
(45) Date of Patent: Jul. 12, 2016

(54) ALUMINUM FOIL AND STRETCH FILM CUTTING MACHINE

(71) Applicant: Tanju Birbil, Muratpasa/Antalya (TR)

(72) Inventor: Tanju Birbil, Muratpasa/Antalya (TR)

( * ) Notice: Subject to any disclaimer, the term of this patent is extended or adjusted under 35 U.S.C. 154(b) by 167 days.

(21) Appl. No.: 14/227,232

(22) Filed: Mar. 27, 2014

(65) Prior Publication Data

US 2014/0208907 A1 Jul. 31, 2014

Related U.S. Application Data

(63) Continuation of application No. PCT/TR2012/000162, filed on Sep. 11, 2012.

(30) Foreign Application Priority Data

Sep. 28, 2011 (TR) ..... 2011/09580

(51) Int. Cl.
*B65H 35/00* (2006.01)
*B26D 1/06* (2006.01)

(52) U.S. Cl.
CPC ..... *B26D 1/065* (2013.01); *B65H 35/002* (2013.01); *B65H 35/0086* (2013.01); *B65H 2701/1732* (2013.01); *B65H 2701/1752* (2013.01); *Y10T 83/50* (2015.04); *Y10T 83/889* (2015.04); *Y10T 83/896* (2015.04)

(58) Field of Classification Search
CPC ..... B26D 1/065; B26D 1/08; B65H 35/0086; Y10T 83/50; Y10T 83/889; Y10T 83/896; Y10T 225/246; Y10T 225/247; Y10T 225/254
See application file for complete search history.

(56) References Cited

U.S. PATENT DOCUMENTS 5,222,644 A * 6/1993 Moreno ..... B65H 35/002 225/19
5,630,563 A * 5/1997 Meisner ..... B65H 35/002 225/43
2005/0072826 A1* 4/2005 Sewell ..... B65D 83/0841 225/49

FOREIGN PATENT DOCUMENTS

EP 1026113 A2 8/2000
EP 1026113 A2 * 8/2000
WO 2013048357 A1 4/2013

OTHER PUBLICATIONS

International Search Report dated Mar. 5, 2013 in PCT/TR2012/000162, 2 pages.

* cited by examiner

*Primary Examiner* — Stephen Choi
(74) *Attorney, Agent, or Firm* — Merchant & Gould P.C.

(57) ABSTRACT

A mechanism used for cutting aluminum foil or stretch film.

3 Claims, 4 Drawing Sheets

ALUMINUM FOIL AND STRETCH FILM CUTTING MACHINE

CROSS REFERENCE TO RELATED APPLICATIONS

This application is a continuation of International PCT Patent Application No. PCT/TR2012/000162 filed Sep. 11, 2012, which claims the benefit of Turkish Application TR 2011/09580 filed on Sep. 28, 2011, which are incorporated herein by reference in their entireties for all purposes.

TECHNICAL FIELD

The present invention relates to a machine structure used for cutting such products as aluminum foil and stretch film which are both made use of for wrapping food products to protect them, and the said mechanism being manufactured for use at homes and particularly in the kitchens of business organizations.

BACKGROUND

Aluminum foil and stretch film are among the products frequently used for packing food products hygienically during the conservation of the food. These two types of products are preferred to be used for food products depending on the intended purpose. In addition, they are used for conserving products and materials and for wrapping surfaces thereof in various fields.

Aluminum foils protect food in hot or cold state; moreover, they protect food from getting dry and burnt during cooking. Thus, harmful substances as a result of burns are prevented. Food products can be protected from external factors by wrapping with aluminum foil. It can be made use of for applying different cooking techniques, for covering meals while baking, for preserving charcuterie products, and even for preserving some food without using plates. Moreover, they appeal to the eye in decorative terms.

Stretch film is another packing product which is used for preservation purposes in many fields, particularly in protection of food products. Thanks to stretch film, any food can be kept in fresh condition for longer time periods. Furthermore, glass brims are wrapped and closed with stretch film, thereby preventing the fluid inside from being poured. Likewise, breakfast food can be wrapped practically and kept fresh. Such foods as sandwiches can be wrapped and kept fresh by means of stretch film, and they can be preserved clean during travel. Sera stretch film can be used for providing a fast, homogenous, and thorough heating in microwave ovens. The food is heated without losing moisture end getting dry. Moreover, liquid foods will be prevented from splashing and making the inside of the oven dirty.

Aluminum foils and stretch films, which are frequently used thanks to the above mentioned advantages, should be cut in amounts needed when to be used. However, it is rather difficult for the user to cut the aluminum foil and stretch film in desired size properly and evenly due to such characteristics, in respective order, as laminar form and quite flexible structure, since, even when cutters are used, stretch film sticks to appliances such as knife; and aluminum foil breaks into pieces owing to the fine structure thereof, the pieces being too small to be used and having different sizes, and in some cases, the cut piece wrinkles and sticks to itself in the point tried to be cut or split. As a result, one wastes quite a lot of time while using aluminum foil or stretch film; in fact, such products intended to make our daily lives practical may make things difficult for the user contrary to what one expects from such products. Because of extra wasted pieces as a result of difficulties experienced during the use of aluminum foil or stretch film, the products are consumed more than needed, which causes material damage.

Currently used aluminum foils and stretch films are sold in a box package in rolled form, the said box being configured so as to have an opening part in the long side and a cutter with a sharp and knurled edge positioned again in the said long side. However, such cutting appliances require use of both hands; moreover, foil or film cannot be removed from the roll properly in equal sizes despite the cutter structure thereon, and an even cutting operation along the cutter cannot be performed.

After stretch film or aluminum foil is removed from the box and cut, a very short piece remains and the said piece sticks to the box. Therefore, it becomes quite difficult to hold the foil in the subsequent use. Another disadvantageous feature is that the foil roll may be squeezed while being taken out since it does not rotate about a fixed axis inside the box; in fact, the roll may get out of the box when further impelled. In some cases, stretch film taken by two hands may stick to each other when an end is released to cut, making it unusable.

Aluminum foil and stretch film cutting machine according to the present invention eliminates the above mentioned problems regarding the current foil and stretch film cutting apparatuses, and offers solutions providing great ease in use.

SUMMARY OF THE INVENTION

It is the object of the present invention to provide an even foil flow by placing the roll to which aluminum foil or stretch film is wrapped on a fixed axis, and to prevent the roll from getting out of the box. Furthermore, the machine mechanism of the invention allows ease of use for the user and enables the foil or film to be cut evenly. The machine according to the invention allows the use of roll of any dimension thanks to the roll shaft within its structure.

As mentioned above, aluminum foil and stretch film cutting machine of the invention is capable of cutting plastic derivative stretch film or aluminum foil products easily and properly; besides, it is also characterized by cutting for example oven paper, thin paper roll etc. through the roll by directing straightly.

DETAILED DESCRIPTION OF THE DRAWINGS

FIG. 1 is the front cross view of aluminum foil and stretch film cutting machine when its cover is opened FIG. 2 is the cross view illustrating the installation of roll shaft to the box.

FIG. 3 is the cross view of aluminum foil and stretch film cutting machine when gear system is demounted.

FIG. 4 is the cross view of the upper cover of aluminum foil and stretch film cutting machine.

FIG. 5 is the front view of the main body of aluminum foil and stretch film cutting machine.

FIG. 6 is the perspective view of roll shaft.

FIG. 7 is the top cross view of the roll shaft when it is mounted to right module in the main body.

FIG. 8 is the right module cross view of the main body of aluminum foil and stretch film cutting machine.

The parts of aluminum foil and stretch film cutting machine illustrated in figures are numerated individually and the corresponding numbers are given below:

1. Upper cover

2. Roll shaft

2.1. Roll shaft bearing

2.2. Plus-shaped hole
3. Detent gear
4. Detent
5. Smooth transmission gear
6. Cutter gear
7. Cutter spring
8. Cutter
9. Wall-mount hole
10. Cover pin
11. Cover spring pin
12. Cover spring
13. Finger hole
14. Main body
15. Transmission threshold
16. Conical transmission gear
17. Interior mechanism body cover
18. Helical spring gear
18.1. Plus-shaped protrusion
19. Interior mechanism body
20. Helical spring gear nail
21. Roll shaft fixing nail

DESCRIPTION OF THE DRAWINGS

The present invention, which is a machine in the form of a box with aluminum foil or stretch film inside and which is used for cutting these products, comprises a main body (14) having a cutter mechanism; an upper cover (1) with sharp teeth in the front long edge, which is mounted to the main body (14) from the back long edge; a roll shaft (2) to which the roll is to be placed in the main body (14); a roll shaft bearing (2.1) to which the roll shaft (2) is to be placed inside the right module in the main body (14) wall; a flexible roll shaft fixing nail (21) enabling the fixation of the roll into the bearing in the lower part of the roll shaft bearing; a plus-shaped hole (2.2) on the other opposite edge of the roll shaft (2); a helical spring gear (18) positioned to be placed into the plus-shaped hole (2.2) in the edge part of the roll shaft (2); a plus-shaped protrusion (18.1) positioned to place the roll shaft (2) onto the helical spring gear (18); a helical spring inside the hole in the center behind the helical spring gear (18); helical spring gear nail (20); interior mechanism body (19) to which the interior mechanism is placed; detent gear (3) behind helical spring gear (18) of the interior mechanism body cover (17); a detent (4); a transmission gear (5) that is positioned in a way that its teeth are engaged in the teeth of detent gear and that transmits the movement of detent gear (3) to conical transmission gear (16); a conical transmission gear (16) coupled to transmission gear (5) (as clearly seen in FIG. 3); a cutter gear (6) that is perpendicularly positioned in front of the machine with a 90° angle to conical transmission gear (16) and that is capable of rotating by the movement of conical transmission gear (16); a cutter (8) with zigzag teeth thereon which is positioned in the part contacting with the cover (1) in the upper front part of the main body (14), the said cutter performing the foil or film cutting operation by moving forward and backward with the movement of cutter gear (6); a cutter spring (7) that is positioned immediately below the cutter in a way that it will be in the middle part and that supports back and forth movement of the cutter; two cover pins (10) positioned close to two corners where upper cover is connected to the main body; a cover spring pin (11) positioned immediately below the cover pin (10) such that it will contact with cover pin; and a cover spring (12) below cover spring pin (11), the said cover spring being fixed onto the bottom of the main body (14). The holes provided in two lateral ends of the aluminum foil and stretch film cutting machine according to the invention are finger holes (13) enabling the user to hold the foil therein from two ends easily by placing his/her index fingers into the holes when the upper cover (1) is in closed state. At the same time, lifting the fingers not only opens the upper cover (1), but also allows the foil to be taken out without any difficulty.

A transmission threshold (15) is provided in front of the roll shaft (2) and immediately behind the cutter (8) of the aluminum foil and stretch film cutting machine according to the present invention. One fold of the foil or film rolled on the roll shaft (2) comes from the transmission threshold (15), and the foil pressed between the teeth of the cover (1) is in stretched position. That is, the roll shaft (2) of the invention provides a proper foil flow by fixing the roll onto a fixed axis. Moreover, it prevents the roll from getting out and allows for the use of roll of any diameter thanks to the springs thereon.

On the rear edge of the main body (14) are wall-mount holes (9) so as to provide ease of use for the said aluminum foil and stretch film cutting machine. Thanks to these holes (9), the machine can be mounted on the wall from the rear, and it can be fixed anywhere desired according to the height of the user, thereby providing space savings.

Figure 1:
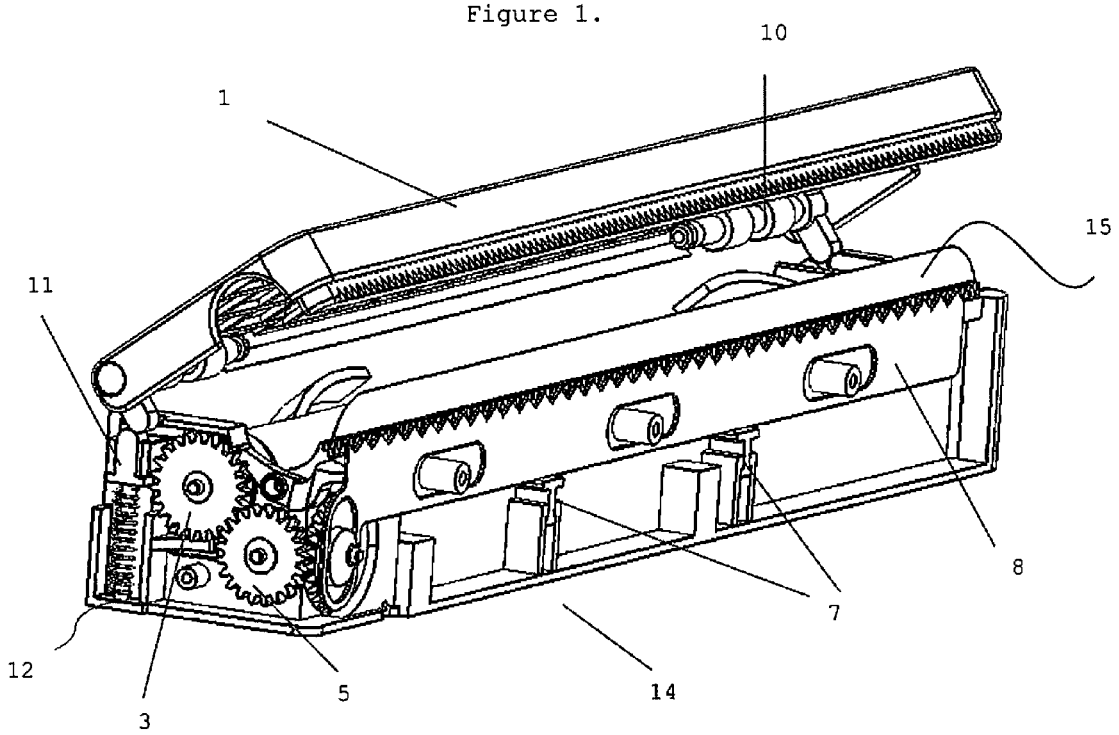
Figure 2:
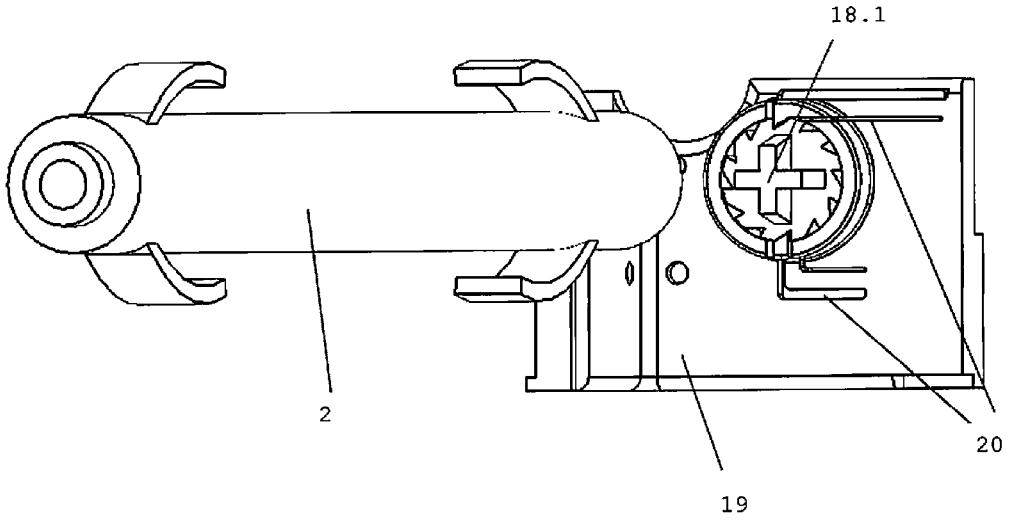
Figure 3:
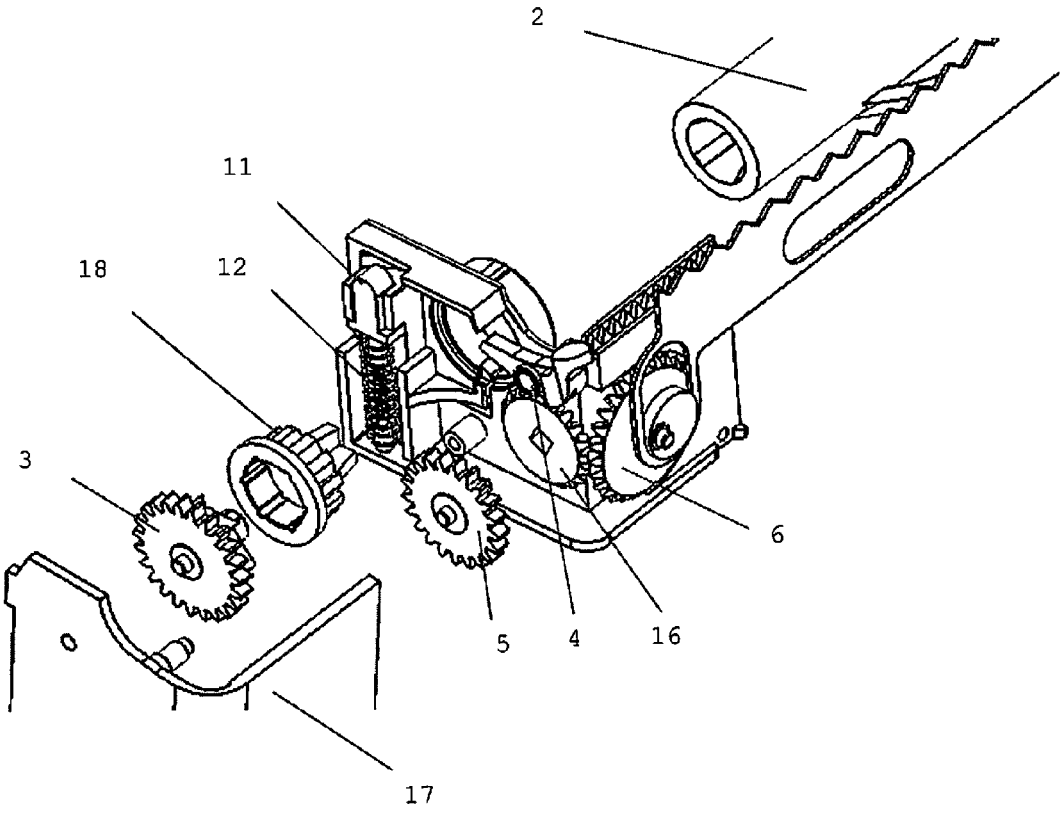
Figure 4:
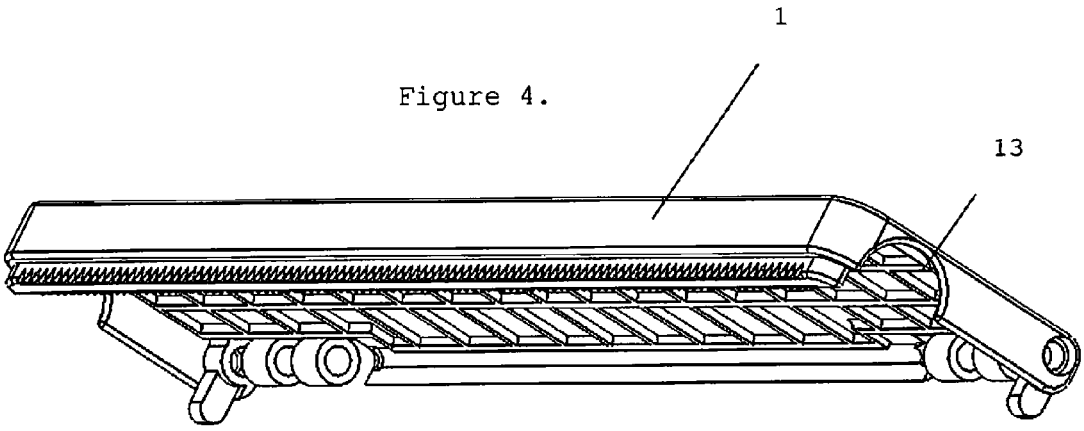
Figure 5:
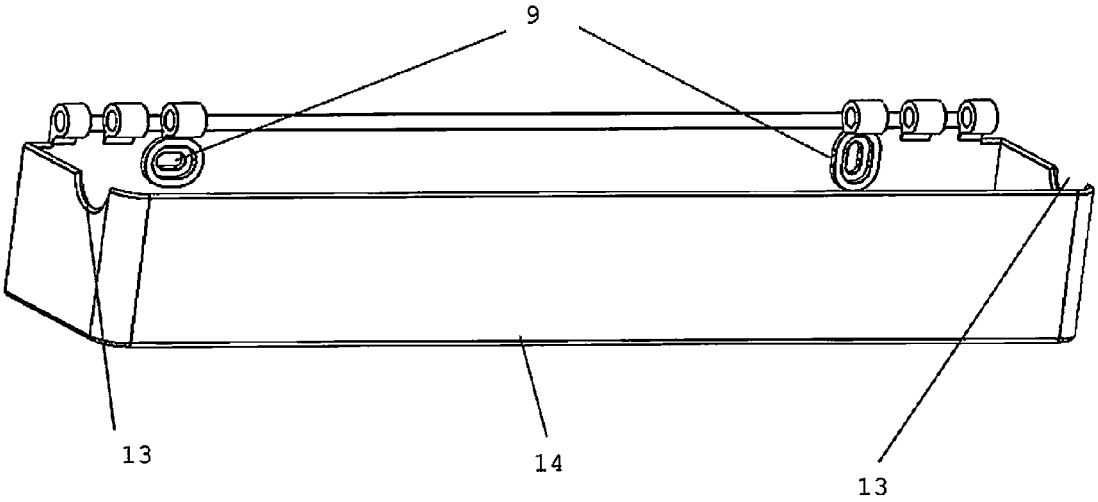
Figure 6:
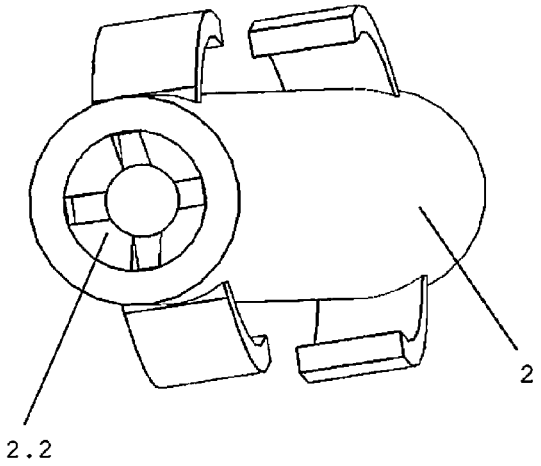
Figure 7:
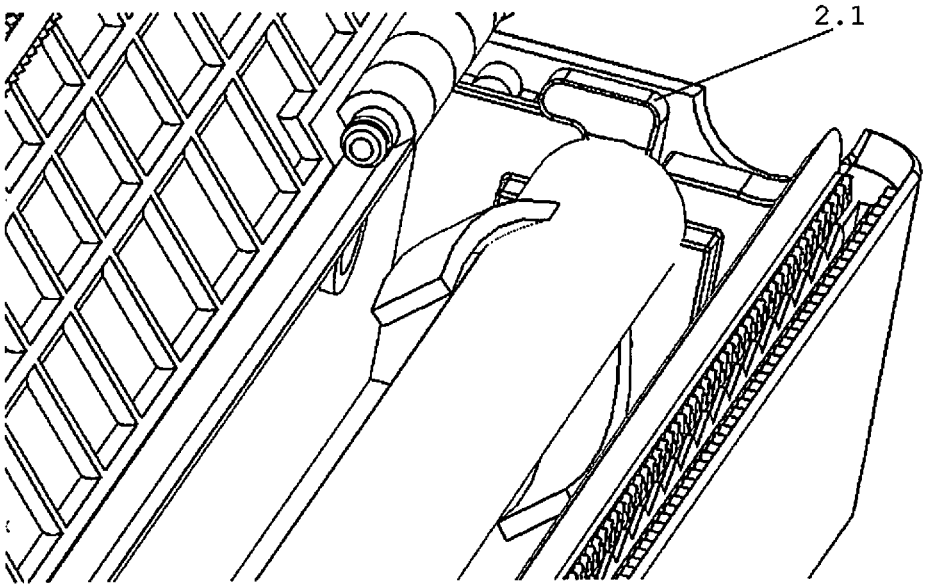
Figure 8:
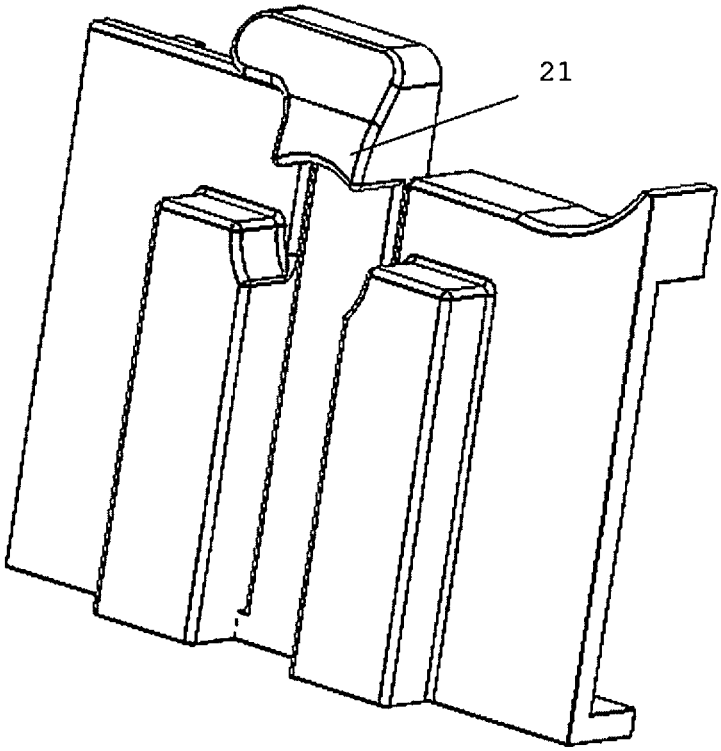

The operating mechanism of aluminum foil and stretch film cutting machine according to the invention is described as follows:

After the roll shaft (2) comprised in the aluminum foil and stretch film cutting machine is passed through stretch roll, plus-shaped hole (2.2) of the roll shaft is inserted such that it will fit well with the plus-shaped protrusion (18.1) on the helical spring gear (18) while the roll is being fixed to the box. Thus, stretch/aluminum foil rotates the roll shaft (2) to which it is attached while being taken out of the box, and the roll shaft (2) rotating the helical spring gear (18) to which it is attached. Helical spring is provided inside the helical spring gear (18) and is attached from the inside to the notches at the end of the detent gear (3). As shown in FIG. 2, the helical spring gear nails (20) on the interior mechanism body (19) permits the rotation of the gear only in the pulling direction of the roll. The detent gear (3) to which the other end of the helical spring is attached cannot rotate since it is held by the detent, thereby the helical spring is wound. The detent gear (3) released by the detent (4) when the upper cover (1) is closed (FIG. 3), it starts rotating with the effect of the wound helical spring and makes the smooth transmission gear (5) rotate as well. The conical transmission gear (16) attached to the smooth transmission gear (5) rotates the cutter gear (6). The rotation movement of the cutter gear (6) allows back and forward movement of the cutter. Thus, the stretch pressed between upper cover (1) and main body (14) beneath the zigzag teeth is cut.

The invention claimed is:

1. An aluminum foil and stretch film cutting machine comprising a main body having a cutter mechanism; an upper cover with sharp teeth along a front long edge and mounted to the main body from a back long edge; a roll shaft to which a roll is to be placed in the main body; a roll shaft bearing placed inside a right module in a main body wall and whereon the roll shaft is to be placed; a flexible roll shaft fixing nail enabling the fixation of the roll into a bearing part in a lower part of the roll shaft bearing; a plus-shaped hole on the other opposite edge of the roll shaft; a helical spring gear positioned to be placed into the plus-shaped hole in the edge part of the roll shaft; a plus-shaped protrusion positioned to place the roll shaft onto the helical spring gear; a helical spring inside a hole in a center behind the helical spring gear; a helical spring gear nail; an interior mechanism body whereon an interior mechanism is placed; a detent gear behind the helical spring gear of an interior mechanism body cover; a detent; a transmission gear positioned in a way that a plurality of teeth of the transmission gear are engaged in the teeth of the detent gear and that transmits the movement of the detent gear to a conical transmission gear; the conical transmission gear coupled to the transmission gear; a cutter gear perpendicularly positioned in front of the machine with a 90.degree. angle to the conical transmission gear and capable of rotating by the movement of the conical transmission gear; a cutter having zigzag teeth thereon and positioned in the part contacting with the cover in an upper front part of the main body, the cutter performing the foil or film cutting operation by moving forward and backward with the movement of the cutter gear; a cutter spring that is positioned immediately below the cutter in a way that the cutter spring will be in a middle part and that supports back and forth movement of the cutter; two cover pins positioned close to two corners where the upper cover is connected to the main body; a cover spring pin positioned immediately below the cover pin such that the cover spring pin will contact with cover pin; and the cover spring below cover spring pin, the cover spring being fixed onto a bottom of the main body.

2. The aluminum foil and stretch film cutting machine according to claim 1, characterized in that finger holes are provided in two lateral ends of the aluminum foil and stretch film cutting machine.

3. The aluminum foil and stretch film cutting machine according to claim 1, characterized in that two holes are provided at a rear end of the main body to allow the mounting of the machine to a wall.

* * * * *